US005291878A

United States Patent [19]

Lombardo et al.

[11] Patent Number: 5,291,878

[45] Date of Patent: Mar. 8, 1994

[54] BABY TEETHING GUM MASSAGER

[76] Inventors: Steve Lombardo; Joni B. Lombardo, both of 680 Skylark La., Port Charlotte, Fla. 33952

[21] Appl. No.: 913,066

[22] Filed: Jul. 14, 1992

[51] Int. Cl.[5] ..... A61H 7/00; A46B 9/04

[52] U.S. Cl. ..... 128/62 A; 128/62 R; 128/67; 15/110; 15/167.2; 606/235

[58] Field of Search ..... 128/44, 67, 59-62 R, 128/62 A; 15/167.1, 167.2, 110; 606/234-236

[56] References Cited

U.S. PATENT DOCUMENTS

| | | | |
|---|---|---|---|
| 1,002,468 | 9/1911 | Strangman | 128/62 A |
| 1,892,068 | 12/1932 | Metzler | 128/62 A |
| 2,121,358 | 6/1938 | Loeffler | 15/167.1 |
| 2,273,207 | 2/1942 | Kuhn | 15/167.1 |
| 2,826,201 | 3/1958 | Yoder | 606/235 |
| 3,214,776 | 11/1965 | Bercovitz | 15/167.1 X |
| 3,720,975 | 3/1973 | Nelson | 128/62 A |
| 3,753,266 | 8/1973 | Ceniceros | 15/110 |
| 4,053,959 | 10/1977 | Wiley | 15/167.1 X |
| 4,454,623 | 6/1984 | O'Halloran | 15/143.1 X |
| 4,654,921 | 4/1987 | Dinner | 15/167.1 |
| 4,831,676 | 5/1989 | Denmark | 128/62 A X |
| 4,888,844 | 12/1989 | Maggs | 15/167.1 X |
| 5,027,463 | 7/1991 | Daub | 15/167.1 |
| 5,048,143 | 9/1991 | Carroll | 15/110 |
| 5,138,737 | 8/1992 | Thomas | 15/167.1 X |

FOREIGN PATENT DOCUMENTS

| | | | |
|---|---|---|---|
| 0383315 | 8/1990 | European Pat. Off. | 128/62 A |
| 2067069 | 7/1981 | United Kingdom | 128/62 A |

*Primary Examiner*—Robert A. Hafer
*Assistant Examiner*—Brian E. Hanlon
*Attorney, Agent, or Firm*—Frank A. Lukasik

[57] ABSTRACT

The baby teething gum massager has a body in the shape of a figure eight with a forward curved portion dimensioned to fit within a child's opened mouth and a rearward curved portion which is wider than a child's mouth, the forward curved portion containing a plurality of tufts of bristles embedded on opposite sides of the forward portion in a conventional manner to provide a large number of contact surfaces and permit flexing of the bristles when the infant bites down so that the cusp tips of the unerupted teeth can bite into the bristles to assist in forcing the teeth through the soft tissue of the gums.

1 Claim, 1 Drawing Sheet

BABY TEETHING GUM MASSAGER

FIELD OF THE INVENTION

The present invention relates generally to teething and massaging devices, and more particularly, to teething and massaging devices for use by infants or small children to assist in the teething process and also massaging the gums to assist in the normal development of the child's mouth.

BACKGROUND OF THE INVENTION

Teething devices, tooth brushes and pacifiers are common in the art as separate devices. Teething devices and tooth brushes and teething devices and pacifiers are also found in combined versions.

A first teething device is shown in U.S. Pat. No. 1,826,943 to maker which discloses a unitary piece of rubber, elliptical at one end and of lobular form at the other end, either end of which acts as a handle in the manipulation of the device. Upon the opposite sides of the device are formed a plurality of spaced tit like projections or stipules and formed about the entire opposite surfaces of the device. Another teething device is shown in U.S. Pat. No. 2,826,201 to Yoder which discloses a teething device comprising a body of resilient material having a cavity formed therein, an opening formed in a wall of the cavity providing an opening to the exterior of the body a piece of confection mounted within the cavity with a portion thereof exposed through the opening of the cavity wall, the confection being held in place by opposed bosses of reduced thickness. In order to increase the teething action, a series of relatively small protuberances are formed integrally on the surfaces of the device.

U.S. Pat. No. 3,669,117 to Herbst discloses a combination teether and pacifier in the form of a thin walled, flexible body having nipple, guard, and teething portions which are hollow and in communicating relation with each other. A soft, compressible body of gel or liquid fills the hollow portions, the device and its compressible contents adapted to be cooled before use to attain maximum soothing effects for the user. Another combination is disclosed in U.S. Pat. No. 5,048,143 to Carroll which discloses a combination tooth brush and teething device having a body in the shape of a closed ring with a forward curved portion dimensioned to fit within a child's opened mouth. A rearward curved portion forms a handle for gripping by a child. A brush head formed of a plurality of upstanding flexible bristles extends from the forward curved portion of the body. To facilitate teething, a plurality of protruding teething bumps may be located on the rearward portion of the body for biting engagement with the child's teeth and gums.

Disadvantages of prior art teethers include lack of sufficient massaging elements such as bumps or stipules or long bristles. Regular toothbrushes are generally too difficult to manipulate for an infant and present dangers of injury to an unsupervised toddler. Teething devices, although generally safer, do not provide adequate massaging qualities to soothe the child's itching gums. Chewable teething rings to assist children are known but these do not provide the necessary firmness nor flexibility to provide relief for the child. Toothbrushes having graspable ring-like handles with outwardly extending horizontal brush head are known which make manipulation by younger children possible, but these brushes still present the dangers of over-insertion into the child's mouth.

What is needed is a single implement that may be used safely and without supervision by infants and young children which will assist tooth eruption and provide relief from the discomfort of tooth growth.

SUMMARY OF THE INVENTION

The baby teething gum massager of the invention has a body in the shape of a figure eight with a forward curved portion dimensioned to fit within a child's opened mouth. The body has a rearward curved portion which is wider than a child's opened mouth so as to prevent the body from being inserted fully into a child's mouth. The rearward curved portion forms a handle for gripping by a child. The forward curved portion contains a plurality of bristles on opposite large surfaces thus forming the elements of the massaging surfaces. The forward portion is slightly angled from the rearward portion to facilitate access and comfort in oral positioning.

It is a principal object of the invention to provide a device which will materially assist in the teething process, also massage the gums and exercise the teeth of the child which will assist in the normal development of the child's mouth.

Another object of the invention is to provide such a device free from any tendency towards the development of the habit of sucking by the child.

Still another object of the invention is to provide a child's teething device which may be safely employed by an infant or toddler without danger of lodging within the throat.

Yet another object of the invention is to provide a child's teething device having bristles on opposite sides of the massaging section.

Further objects, features, and advantages of the invention will be apparent from the following detailed description when taken in conjunction with the accompanying drawings.

DESCRIPTION OF THE PREFERRED EMBODIMENT

Figure 2:
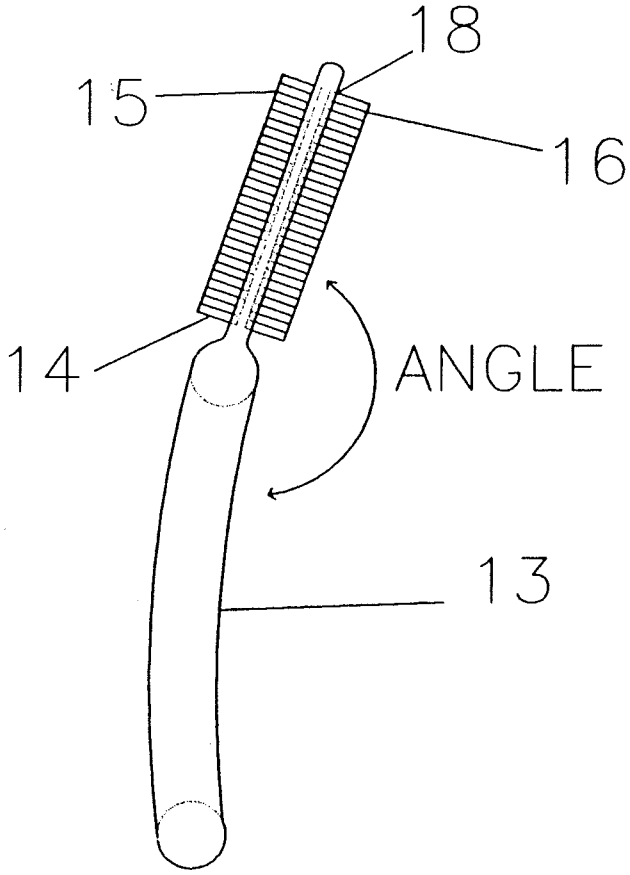
FIG. 2 is a side elevational view of the teething device of the invention.
Figure 1:
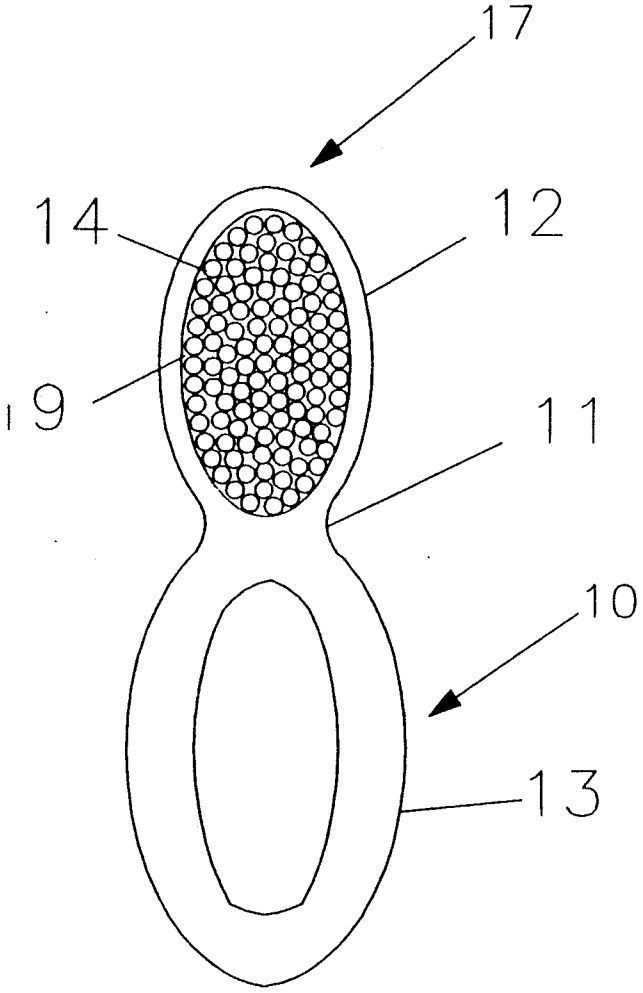
FIG. 1 is a front elevational view of the teething device of the invention.

Referring to FIGS. 1 and 2, a teething gum massager is generally illustrated as numeral 10. The teething gum massager 10 is preferably formed of injection molded plastic and has a body 11 which is generally in the shape of a figure eight with a curved forward portion 12 dimensioned to fit within a child's opened mouth. The rearward curved portion 13, shaped to form a grasping ring handle, is wider than a child's opened mouth so as to prevent the body 10 from being inserted fully into a child's mouth. The rearward curved portion 13 provides a convenient handle for gripping by the hand of a small child. The forward curved portion 12 contains a plurality of bristles 14 on opposite sides of forward curved portion 12 to form the elements of the massaging surfaces 15 and 16. The forward portion is angled as shown to create a more readily accessible device. The massaging surfaces 15 and 16 are comprised of randomly aligned rows 17 of tufts of bristles 14 which extend from the top surfaces 18 and 19 of the forward portion 12. In a preferred embodiment, the tufts of bristles 14 were approximately 1/16 inch in thickness, positioned at increments of 1/32 apart, spaced evenly from the perimeter of the forward portion 12, and were made from soft bristles approximately 3/16 inch in length. The plastic forward portion 12 having tuft attachment surfaces 18 and 19 was approximately 3/16 inch with the massaging tufts of bristles 14 in multiple rows, running the circumference and covering the surfaces 18 and 19. The bristles 14 of the teething gum massager 10 are embedded in the plastic body of the forward portion 12 in a conventional manner to permit flexing of the bristles 14 while being securely retained on the gum massager 10.

The body 11 is formed with curved and rounded edges so that no sharp angles are presented to the child's soft tissue which might cause damage. Typically, a child's mouth will be no wider than 1½ inches and approximately 2 inches in depth. A typical gum massager 10 would have a forward portion 12 approximately 1¼ inches wide with the rearward portion 1¾ inches wide. The rearward portion 13 is thus larger than the maximum width of a child's mouth. Because the gum massager 10 is curved along the body 11, there is no protruding narrow member which would present a danger of trauma to the child's throat or mouth. Furthermore, as the gum massager 10 is inserted and withdrawn from the child's mouth, all of the bristles 14 are presented to the child's gums and teeth.

The teething gum massager 10 may be effectively used by an infant prior to the eruption of his teeth. A teething child will have a natural tendency to place objects in his mouth and to bite down upon them. Merely presenting the infant with the teething gum massager 10 will be sufficient to initiate the infant's use of the article. First the bristles 14 of the teething gum massager 10 work to remove plaque from the infant's gums as well as to improve circulation by massaging the gums. Secondly, the large area of tufts of relatively short bristles 15 provide a large number of contact surfaces which initially provide pressure resistance against the gums when the infant bites down so that the cusp tips of the unerupted teeth can bite into the bristles to assist in forcing the teeth through the soft tissue of the gums. In addition to massaging the top surfaces of the gums, as the bristles 14 yield to the biting pressure, the bristles 14 adjacent to the bristles bent by the biting action will gently massage the sides of the gums as they pass by. Unlike other prior art teething devices, the upper and lower bristles 14 are equally effective in massaging the upper and lower gums simultaneously and effectively.

It should be noted that the teething gum massager 10 of this invention may be fabricated with a greater or lesser number of teething bristles 14 of varying sizes and dimensions and that the forward portion 12 may have more or fewer tufted bristles 14 in varying effective arrangements. The body 11 may be formed of a stiff plastic or alternatively may be a resilient material. The forward and rearward portions 12 and 13 of the body 10 are preferably in the form of simple curves as shown.

It is understood that the invention is not confined to the particular construction and arrangement of parts illustrated and described, but embraces such modified forms thereof as come within the scope of the following claims.

What I claim is:

1. A teething gum massager for a child, said massager having curved and rounded edges, said massager comprising:

a figure eight shaped body having a first portion and a second portion, said first and second portions forming a juncture, said first portion having a top surface and a bottom surface, each of said surfaces defining a plane, said first portion sized for being fully inserted into said child's opened mouth, and said first portion having an exterior rim surrounding a bristle mounting area on said top surface and said bottom surface, a plurality of tufted bristles extending from said bristle mounted area on said top surface and said bottom surface of said first portion, in randomly aligned rows of tufts substantially covering said top and bottom surfaces for gently massaging the tops and sides of the upper and lower gums simultaneously, said second portion, shaped to form a grasping handle, and wider than a child's opened mouth to prevent said body from being inserted fully into a child's mouth, and said body having opposed recesses adjacent said juncture.

* * * * *